United States Patent [19]

Pohl et al.

[11] Patent Number: 4,643,706

[45] Date of Patent: Feb. 17, 1987

[54] ONE-SIDED CORRUGATED CARDBOARD MACHINE

[75] Inventors: Walter Pohl; Uwe Wetterling, both of Hamburg, Fed. Rep. of Germany

[73] Assignee: Werner H. K. Peters Maschinenfabrik GmbH, Hambrug, Fed. Rep. of Germany

[21] Appl. No.: 660,910

[22] Filed: Oct. 15, 1984

[30] Foreign Application Priority Data

Nov. 7, 1983 [DE] Fed. Rep. of Germany ... 8331821[U]

[51] Int. Cl.[4] ..... B31F 1/20

[52] U.S. Cl. ..... 493/463; 493/477; 156/206; 156/210; 156/47 Z; 156/462; 264/286

[58] Field of Search ..... 493/477, 480, 463, 434, 493/435; 156/205, 206, 209, 210, 471, 472, 462, 459; 264/286; 72/238, 237

[56] References Cited

U.S. PATENT DOCUMENTS

| | | | |
|---|---|---|---|
| 2,720,910 | 10/1955 | Rockstrom et al. | 156/472 |
| 3,053,309 | 9/1962 | Wilson et al. | 156/205 |
| 3,484,320 | 12/1969 | David | 264/286 |
| 4,177,102 | 12/1979 | Tokuno | 156/472 |
| 4,251,313 | 2/1981 | Abe | 156/205 |
| 4,481,066 | 11/1984 | Hirakawa et al. | 156/472 |

FOREIGN PATENT DOCUMENTS

| | | | |
|---|---|---|---|
| 1110115 | 7/1961 | Fed. Rep. of Germany | 72/237 |
| 2084074 | 4/1982 | United Kingdom | 156/462 |

*Primary Examiner*—Lowell A. Larson
*Assistant Examiner*—David B. Jones
*Attorney, Agent, or Firm*—Harness, Dickey & Pierce

[57] ABSTRACT

A one-sided corrugated cardboard machine comprising a machine stand with two fluted rollers in meshing engagement with each other and an auxiliary roller rotatably supported therein, the axes of said rollers being disposed approximately in a common plane preferably inclined towards the vertical, with the machine stand being supported at the underground on one side of the plane, and members cooperating with the roller pack such as deviation rollers, guide plates, scrapers for the pressure roller, and the like, being supported in a stand section on the other side of the plane, said section being a rigid frame spanning the roller pack and which is detachably yet fixedly connectible to the machine stand.

12 Claims, 1 Drawing Figure

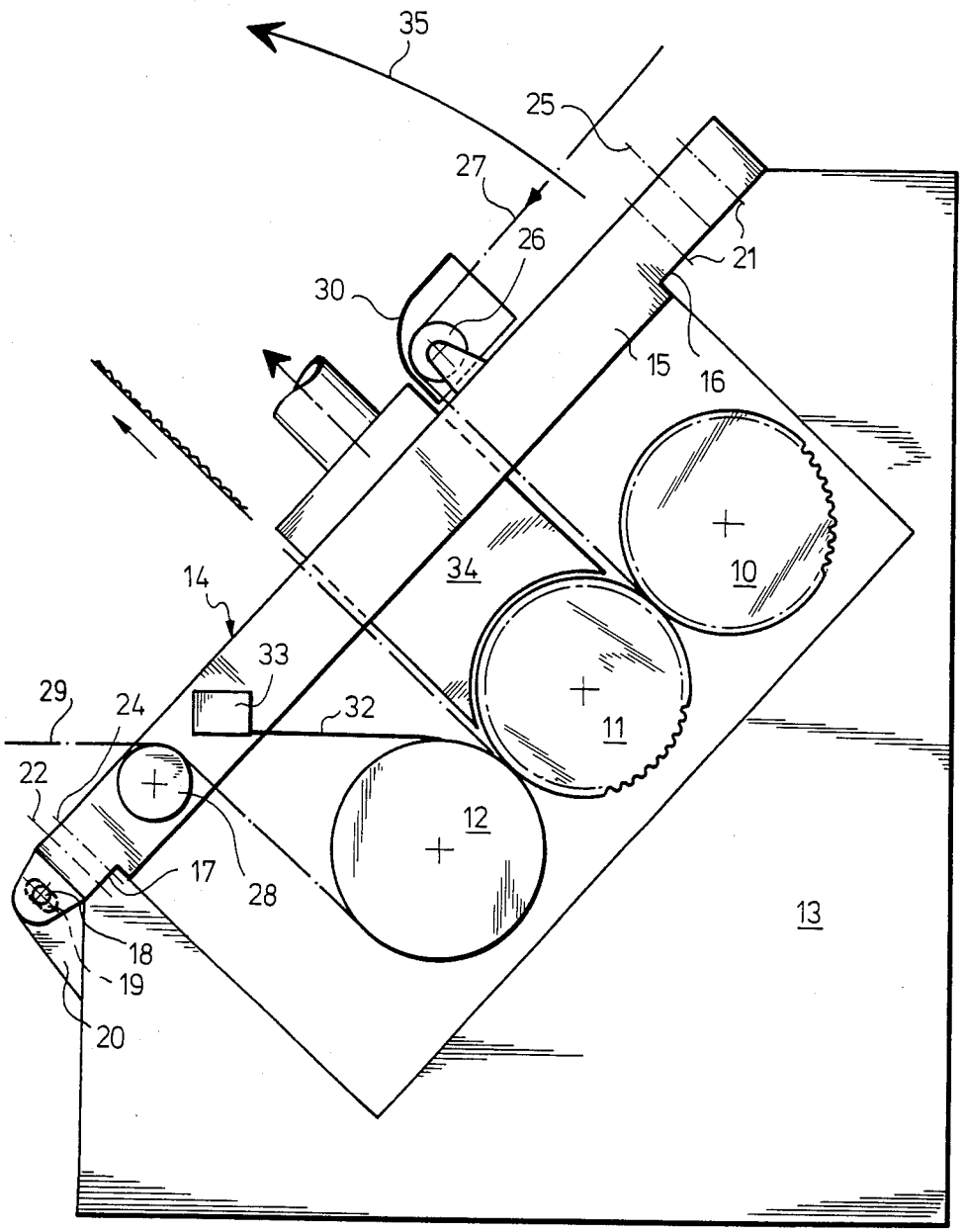
35
25
27
26
21
30
15
16
10
34
14
33
11
29
24
32
22
12
17
28
13
18
19
20

ONE-SIDED CORRUGATED CARDBOARD MACHINE

The innovation relates to a one-sided corrugated cardboard machine comprising a machine stand with two fluted rollers in meshing engagement with each other and a pressure roller rotatably supported therein, the axes of said rollers being disposed approximately in a common plane preferably inclined towards the vertical, with the machine stand being supported at the underground on one side of said plane, and members cooperating with the roller pack such as deviation rollers, guide plates, scrapers for the pressure roller, and the like, being supported in a stand section on the other side of the plane.

Such one-sided cardboard machines have become known in most different embodiments. The glue applicator means is usually disposed on that side of the machine stand which is supported on the underground. However, it is extremely difficult with conventional one-sided machines to get access to the roller pack. Access is needed above all when one fluted roller or both fluted rollers are to be disassembled and replaced, respectively. Such replacement may become necessary perhaps when one fluted roller has become damaged or too strongly worn. A replacement may become necessary also if a different corrugation is desired for the web of corrugated cardboard. With conventional corrugated cardboard machines a large number of individual parts must be dismounted and newly mounted, respectively, in order to perform such a change of fluted rollers. Such a procedure takes up to two working days. That means that perhaps a replacement of fluted rollers will result in a relatively long interruption of the production or must be carried out within a period of time during which the corrugated cardboard plant is not in operation.

The innovation is therefore based upon the problem of providing a one-sided corrugated cardboard machine which, for the replacement of a fluted roller, in particular, permits quick and easy access.

This problem is solved in accordance with the innovation in that the stand section is a rigid frame spanning the roller pack, said frame being adapted to be detachably yet fixedly connected to the machine stand.

The portion of the machine stand supported on the underground surrounds the roller pack approximately in a U-shape. The rigid frame spans this portion of the stand and is rigidly connected thereto. The rigid frame thus forms a sort of stiffening or a sort of tie rod opposing the forces urging apart the rollers of the roller pack.

What is of particular importance, however, is that the rigid frame serves to respectively hold and support web processing machine parts which are cooperating with the roller pack. This, for example, is a sheet metal guide member which serves to guide the web of corrugated cardboard between the nip of the corrugated rollers. This includes furthermore a guide roller cooperating with such a sheet metal guide member. As another member cooperating with the roller pack a so-called pressure roller scraper has to be mentioned which takes care that any contaminations adhering at the circumference of the pressure roller are removed. Also the deviation roller which serves to supply the covering web to the pressure roller may be supported in the rigid frame.

The rigid frame, according to the innovation, is detachably connected to the machine stand. It may thus be removed from the machine stand with all the components supported thereat. After the removal of the rigid frame the entire roller pack is freely accessible. After loosening the bearing flanges and the connections for the vapour heating and vapour return, respectively, the rollers may readily be taken out of the machine. By virtue of the rigid frame the time needed for the replacement of a fluted roller may be reduced to about 3 hours. After the loosening of the rigid frame, the latter may be lifted, for example, by means of a hoisting equipment and moved to one side, in order to enable the replacement of a fluted roller. An advantageous embodiment of the innovation provides in this connection for the rigid frame to be supported for pivotable movement about a lower axis of rotation at the machine stand. The rigid frame thus forms a one-armed lever having a pivot point in the lower portion of the machine stand. For the removal of the frame the latter then only needs to be pivoted through a certain angle against a predetermined abutment, so that the roller pack becomes freely accessible from that side.

Fastening of the rigid frame according to another embodiment of the innovation is with the aid of screws which may be inserted both in the upper and lower ends.

The frame may be formed by two parallel carriers connected to each other by means of a transverse strut at the upper end, for example. According to another embodiment of the innovation abutment surfaces in form-closed engagement with each other are provided at the frame and at the machine stand. The form-closed engagement is effective to cause the frame to be fixed in the plane of its extension. A relative displacement of frame and stand in the opposite direction is prevented by screws.

Due to the form-closed engagement greater forces may under certain circumstances be needed to separate frame and stand from each other. Therefore, lifting screws are arranged at the upper and/or lower end of the rigid frame in accordance with another embodiment of the innovation, in order to lift the frame from the machine stand. So that a lifting movement may be effected also in the neighbourhood of the privot point with the aid of a lifting screw, it will be to the purpose for the rotary support to be effected via an elongated hole.

One-sided corrugated cardboard machines often use so-called underpressure or suction boxes which are arranged on that side of the lower fluted roller which is not covered by the corrugated web. A vacuum is created via circumferential grooves formed in the fluted roller which takes care that the corrugated web comes to lie in close contact against the fluted roller. In the case of the one-sided machine according to the innovation such a vacuum box may be arranged also stationarily at the rigid frame. Upon removal of the rigid frame or hinging-down thereof, respectively, the vacuum box is automatically moved along with it.

One example of embodiment of the innovation will be explained in the following in more detail by way of a drawing.

The only FIGURE shows in an extremely diagrammatic view a one-sided machine having a rigid frame.

Prior to enlarging in more detail in the individual components shown in the drawing, it has to be stated that each of the components shown is of essential significance to the innovation by itself and in connection with the features of the claims.

The components shown are extremely schematic and not to scale.

The one-sided machine shown in the FIGURE comprises an upper fluted roller 10 and a lower fluted roller 11 cooperating therewith, as well as a pressure roller 12. The axes of the rollers 10 to 12 are approximately disposed in a plane inclined towards the horizontal at a certain angle. The lower fluted roller 11 has in addition associated therewith a glue applicator means which, however, is not shown here. The rollers 10 to 12 are supported in the machine stand 13 in a manner not shown in any more detail. The lower fluted roller 11 is fixedly supported as regards the axis thereof, while the rollers 10 and 12 are supported in arms in a manner known per se and are respectively pressed against the lower fluted roller 11 with the aid of a pneumatic or hydraulic contact pressure device.

The machine stand 13 encircles around the roller pack in the form of a U-shape. The free access is closed by a rigid frame 14 the plane of which extends approximately in parallel with the plane in which the axes of the rollers 10 to 12 are disposed. The rigid frame 14 consists of two parallel carriers one of them being shown at 15. The carriers 15 may be rigidly connected to each other by one or several struts. The carriers 15 are recessed at 16 at the upper end and at 17 at the lower end, said recesses being in form-closed engagement with a section of the machine stand 13. It will be noted from the FIGURE that the rigid frame 14 in the position as shown is fixed in its plane vis-à-vis displacements in upward and downward directions.

The rigid frame 14 forms a one-armed lever. It comprises pivot pins at its lower end one of them being shown at 18. It cooperates with an elongated hole 19 of a bearing bracket 20. The elongated hole 19 extends approximately normal to the plane of the rigid frame 14. The rigid frame 14 is fixedly connected to the machine stand 13 with the aid of screws as shown at 21 at the upper end and at 22 at the lower end. In addition, lifting screws are arranged in the rigid frame 14 at the upper and lower ends thereof as indicated at 24 and 25, respectively.

In the position as shown in the FIGURE the rigid frame 14 forms a sort of tie rod keeping together the lower and upper portions of the machine stand 13 and preventing them being moved asunder by the pressure acting in diverging senses in the roller pack. Slight deformations already affect the effective engagement of the fluted rollers 10, 11 with each other.

Pivotally supported in the rigid frame 14 are a deviation roller 26 for the web of corrugated material 27 as well as a deviation roller 28 for the web of covering material 29. Coperating with the deviation roller 26 is a guide sheet metal member 30 for the web of corrugated material 27. Likewise fixedly supported at the rigid frame 14 is a pressure roller scraper 32 by means of a bearing constructional member 33. Finally, a vacuum box 34 is also fixedly connected to the rigid frame 14. It cooperates in a manner known per se with the lower fluted roller 11, in order to create by means of suction grooves provided therein extending in a circumferential direction an underpressure on the opposite side for the purpose of adhering the corrugated web to the fluted roller 11 as far as the nip formed with the pressure roller 12.

When the screws 22 and 21 are loosened, the rigid frame 14 may be lifted with the aid of the lifting screws 24, 25 from the machine stand 13 so much that the recesses 16, 17 are out of engagement with the stand 13. Following this the rigid frame 14 may be pivoted off in the direction of the arrow 35. This may be performed for example with the aid of a suitable pulling device or a hoisting equipment. The hinged-off rigid frame 14 after having being pivoted through an angle of from 90° to 120° C. is adapted to come to lie in close contact against a suitable abutment. As may be readily recognized, the roller pack in this manner becomes completely freely accessible. There is no longer any obstructing member present on the side of the roller pack facing the frame 14. Therefore, one or several rollers may be readily taken out of the stand 13 after loosening the bearing flanges and the connections respectively for the supply of vapour and the discharge of condensate.

We claim:

1. A one-sided corrugated cardboard machine comprising a machine stand defining an internal cavity and an opening at a portion of said cavity for affording access to said cavity, a roller pack comprised of two fluted rollers in meshing engagement with each other and a pressure roller rotatably supported within said machine stand internal cavity beneath and accessible through said opening, the axess of said rollers being disposed substantially in a common plane beneath said opening, and web processing members cooperating with said roller pack for forming a web into corrugated cardboard supported on the other side of the plane, characterized in that the cooperating web processing members are carried by a rigid frame comprising a pair of spaced apart side members rigidly interconnected by means of at least one transversely extending member spanning said roller pack and detachably connected by means of removable fasteners to said machine stand and extending across said opening and in proximate to said machine frame for reinforcing said machine frame.

2. A corrugated cardboard machine as set forth in claim 1, wherein the common plane is inclined toward a vertical plane.

3. A corrugated cardboard machine according to claim 1, characterized in that the rigid frame is supported for pivotal movement about an axis to the machine stand and at one side of the opening.

4. A corrugated cardboard machine according to claim 1, characterized in that the frame and the machine stand have abutment surfaces in engagement with each other.

5. A corrugated cardboard machine according to claim 2, characterized in that the frame and the machine stand have abutment surfaces in engagement with each other.

6. A corrugated cardboard machine according to claim 3, characterized in that the frame and the machine stand have abutment surfaces in engagement with each other.

7. A corrugated cardboard machine according to claim 1, characterized in that lifting screws are provided on the rigid frame for lifting the frame from the machine stand.

8. A corrugated cardboard machine according to claim 2, characterized in that lifting screws are provided on the rigid frame for lifting the frame from the machine stand.

9. A corrugated cardboard machine according to claim 3, characterized in that lifting screws are provided on the rigid frame for lifting the frame from the machine stand.

10. A corrugated cardboard machine according to claim 1, further including a vacuum box cooperating with one of the fluted rollers, said box being supported by the rigid frame.

11. A corrugated cardboard machine according to claim 2, further including a vacuum box cooperating with one of the fluted rollers, said vacuum box being supported by the rigid frame.

12. A corrugated cardboard machine according to claim 3, further including a vacuum box cooperating with one of the fluted rollers, said vacuum box being supported by the rigid frame.

* * * * *